US009236657B2

(12) United States Patent
Nagumo et al.

(10) Patent No.: US 9,236,657 B2
(45) Date of Patent: Jan. 12, 2016

(54) ANTENNA DEVICE AND MATCHING CIRCUIT MODULE FOR ANTENNA DEVICE

(71) Applicant: MURATA MANUFACTURING CO., LTD., Kyoto (JP)

(72) Inventors: Shoji Nagumo, Kyoto (JP); Minoru Iwanaga, Kyoto (JP); Masahi Nakazato, Kyoto (JP); Tomohiro Nagai, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 250 days.

(21) Appl. No.: 14/150,511

(22) Filed: Jan. 8, 2014

(65) Prior Publication Data

US 2014/0198009 A1 Jul. 17, 2014

(30) Foreign Application Priority Data

Jan. 17, 2013 (JP) ..... 2013-006115

(51) Int. Cl.

| | |
|---|---|
| ***H01Q 1/24*** | (2006.01) |
| ***H01Q 5/335*** | (2015.01) |
| ***H01Q 21/30*** | (2006.01) |

(52) U.S. Cl.

CPC ..... *H01Q 5/335* (2015.01); *H01Q 1/243* (2013.01); *H01Q 21/30* (2013.01)

(58) Field of Classification Search

CPC ..... H01Q 5/335; H01Q 21/30; H01Q 1/243
See application file for complete search history.

(56) References Cited

U.S. PATENT DOCUMENTS

| | | | | |
|---|---|---|---|---|
| 5,874,926 | A * | 2/1999 | Tsuru | H01Q 1/362 343/713 |
| 6,934,557 | B2 * | 8/2005 | Sekine | H01Q 1/242 330/129 |
| 7,184,727 | B2 * | 2/2007 | Poilasne | G01R 27/2694 343/860 |
| 7,277,677 | B2 * | 10/2007 | Ida | H04B 1/0458 343/703 |
| 7,738,850 | B2 * | 6/2010 | Byun | H04B 1/18 333/129 |

(Continued)

FOREIGN PATENT DOCUMENTS

| | | |
|---|---|---|
| JP | 2000-124728 A | 4/2000 |
| JP | 2002-076738 A | 3/2002 |

(Continued)

OTHER PUBLICATIONS

An Office Action; "Notice of Reasons for Rejection," issued by the Japanese Patent Office on Nov. 18, 2014, which corresponds to Japanese Patent Application No. 2013-006115 and is related to U.S. Appl. No. 14/150,511; with English language translation.

*Primary Examiner* — Hoang V Nguyen
(74) *Attorney, Agent, or Firm* — Studebaker & Brackett PC

(57) ABSTRACT

A low-frequency radiating element and a high-frequency radiating element are configured so as to respectively operate in a relatively low frequency band and a relatively high frequency band that are non-contiguous with each other. A matching circuit is inserted between a transmission/reception circuit and a branching point. A high-frequency variable reactance circuit is inserted between the branching point and the high-frequency radiating element. A low-frequency variable reactance circuit is inserted between the branching point and the low-frequency radiating element. The high-frequency variable reactance circuit and the low-frequency variable reactance circuit are configured such that their reactances can be adjusted independently of each other.

12 Claims, 18 Drawing Sheets

(56) References Cited

U.S. PATENT DOCUMENTS

| | | | | |
|---|---|---|---|---|
| 8,224,239 | B2 * | 7/2012 | Kojima | H04B 1/48 343/702 |
| 2009/0021325 | A1 * | 1/2009 | Lee | H03H 7/40 333/124 |
| 2011/0216686 | A1 | 9/2011 | Wu | |
| 2012/0281384 | A1 | 11/2012 | Hong et al. | |
| 2013/0187824 | A1 | 7/2013 | Kato et al. | |
| 2014/0062817 | A1 | 3/2014 | Ishizuka et al. | |

FOREIGN PATENT DOCUMENTS

| | | | |
|---|---|---|---|
| JP | 2008-172598 | A | 7/2008 |
| JP | 2010-081370 | A | 4/2010 |
| JP | 2011-040811 | A | 2/2011 |
| JP | 2011-061712 | A | 3/2011 |
| JP | 2011-188495 | A | 9/2011 |
| JP | 2012-235451 | A | 11/2012 |
| JP | 2013-207438 | A | 10/2013 |
| WO | 2012/114983 | A1 | 8/2012 |
| WO | 2012/153692 | A1 | 11/2012 |

* cited by examiner

| | STATE 1b | STATE 11 | STATE 12 | STATE 13 |
|---|---|---|---|---|
| XL | 14nH | 1.5pF | 14nH | 20nH |
| XH | 1.5nH | 2.7nH | 8.2nH | 1.5nH |

ANTENNA DEVICE AND MATCHING CIRCUIT MODULE FOR ANTENNA DEVICE

CROSS REFERENCE TO RELATED APPLICATIONS

This application claims benefit of priority to Japanese Patent Application No. 2013-006115 filed Jan. 17, 2013, the entire content of which is incorporated herein by reference.

TECHNICAL FIELD

The present technical field to antenna devices having two radiating elements that operate at different frequencies from each other and to matching circuit modules that can be applied to such antenna devices.

BACKGROUND

In recent years, it has become common for cellular phones to have a radiating element for a low frequency band (0.8 GHz to 0.9 GHz) and a radiating element for a high frequency band (1.7 GHz to 2.0 GHz). An antenna device is known in which a variable matching circuit is inserted between a branching point at which one line branches to two radiating elements, and a transmission/reception circuit (for example, refer to Japanese Unexamined Patent Application Publication No. 2010-81370). One of the radiating elements corresponds to a fundamental frequency band and the other radiating element corresponds to a higher-order frequency band.

The variable matching circuit includes a first matching circuit and a variable capacitance element that is connected in series with the first matching circuit. The first matching circuit includes a grounded inductance element and a capacitance element that is connected in parallel with the grounded inductance element. Even if the capacitance of the variable capacitance element of the variable matching circuit is changed, the resonant frequency in the fundamental frequency band can be easily adjusted without greatly affecting the resonant frequency in the higher-order frequency band.

There are plans to introduce carrier aggregation technology to next generation mobile communication systems. Carrier aggregation technology is a technology for forming a single broad band channel by aggregating carriers of a plurality of non-contiguous frequency bands.

In Japan, examples of combinations of frequency bands that are targets for carrier aggregation include the combination of the 1.5 GHz band and the 2.0 GHz band, the combination of the 0.8 GHz band and the 1.5 GHz band, and the combination of the 0.9 GHz band and the 2.0 GHz band. In the United States of America, examples of combinations of frequency bands that are targets for carrier aggregation include combinations of the 0.7 GHz band and a band in a range from the 1.7 GHz band to the 2.0 GHz band. In this specification, sometimes a band in the range of the 0.8 GHz band to the 0.9 GHz band will be referred to as a low frequency band, the 1.5 GHz band will be referred to as a medium frequency band and a band in the range from the 1.7 GHz band to the 2.0 GHz band will be referred to as a high frequency band. However, this does not mean that bands of the low frequency band, the medium frequency band and the high frequency band are limited to these specific bands. In addition, use of higher frequency bands is also being investigated.

In an antenna device of the related art having two radiating elements, one of which is used for a low frequency band and the other of which is for a high frequency band, it is difficult to simultaneously cover all of the combinations of frequency bands that are targets of carrier aggregation. In order to cover all of the combinations of frequency bands, for example, it might be necessary to prepare three or more radiating elements each having an electrical length that is appropriate for the corresponding frequency band.

SUMMARY

An object of the present disclosure is to provide an antenna device capable of combining frequency bands that can be covered with a high degree of freedom and to provide a matching circuit module that can be mounted in the antenna device.

According to an embodiment of the present disclosure, an antenna device is provided that includes: a low-frequency radiating element and a high-frequency radiating element configured so as to respectively operate in a relatively low frequency band and a relatively high frequency band which are non-contiguous with each other; a transmission/reception circuit; a matching circuit that is inserted between the transmission/reception circuit and a branching point; a high-frequency variable reactance circuit that is inserted between the branching point and the high-frequency radiating element; and a low-frequency variable reactance circuit that is inserted between the branching point and the low-frequency radiating element; the high-frequency variable reactance circuit and the low-frequency variable reactance circuit being configured such that their reactances can be adjusted independently of each other.

The degree of freedom with which frequency bands covered by the antenna device can be combined can be made high by independently adjusting the reactance of the high-frequency variable reactance circuit and the reactance of the low-frequency variable reactance circuit.

The transmission/reception circuit may have a carrier aggregation function of aggregating a carrier of the relatively low frequency band and a carrier of the relatively high frequency band. In a case where power is supplied from the transmission/reception circuit to the high-frequency radiating element and the low-frequency radiating element, the reactances of the high-frequency variable reactance circuit and the low-frequency variable reactance circuit can be set such that return loss from the high-frequency radiating element has a minimum value in the high-frequency band and return loss from the low-frequency radiating element has a minimum value in the low-frequency band.

Since the degree of freedom with which frequency bands covered by the antenna device can be combined is high, the degree of freedom with which frequency bands that are targets of carrier aggregation can be combined is also high.

The matching circuit may include a resonant circuit that causes plural resonances to be generated in the low frequency band or the high frequency band.

The bandwidth of the operational frequency band can be widened by causing plural resonances to be generated.

The transmission/reception circuit may have a function of transmitting and receiving a signal in a third frequency band different from the high-frequency band and the low-frequency band. In a case where power is supplied from the transmission/reception circuit to the high-frequency radiating element and the low-frequency radiating element, the reactances of the high-frequency variable reactance circuit and the low-frequency variable reactance circuit can be set such that the return loss from at least one of the low-frequency radiating element and the high-frequency radiating element has a minimum value in the third frequency band.

Since the degree of freedom with which frequency bands covered by the antenna device can be combined can be made high, the low-frequency radiating element or the high-frequency radiating element can also be applied to a third frequency band.

At least one of the high-frequency variable reactance circuit and the low-frequency variable reactance circuit may include a switch that switches between at least two states selected from a state in which an inductance is inserted, a state in which a capacitance is inserted, a state in which a combination circuit composed of an inductance and a capacitance such as a parallel resonant circuit is inserted, and a through state.

A large change in reactance and a variety of changes in reactance can be realized by changing the reactance using the switch.

The high-frequency variable reactance circuit and the low-frequency variable reactance circuit may be arranged at positions spaced away from a base ground conductor.

Stray capacitances of the high-frequency variable reactance circuit and the low-frequency variable reactance circuit can be reduced. Thus, restrictions on values of reactances that can be obtained are lightened.

The high-frequency variable reactance circuit, the low-frequency variable reactance circuit and the matching circuit form a matching circuit module.

The matching circuit module can be easily mounted in a variety of antenna devices through modularization.

The matching circuit module includes two contact terminals that are respectively in contact with the high-frequency radiating element and the low-frequency radiating element. The two contact terminals maintain a state of being respectively in contact with the high-frequency radiating element and the low-frequency radiating element through their respective elastic forces.

The low-frequency radiating element and the high-frequency radiating element can be easily attached to and detached from the matching circuit module.

According to another embodiment of the present disclosure, a matching circuit module for an antenna device is provided, the matching circuit module including: a matching circuit that is connected to a transmission/reception circuit; two contact terminals that are connected to different radiating elements; a low-frequency variable reactance circuit that is inserted between the matching circuit and one of the contact terminals; and a high-frequency variable reactance circuit that is inserted between the matching circuit and the other one of the contact terminals, where a reactance of the low-frequency variable reactance circuit and a reactance of the high-frequency variable reactance circuit can be changed independently of each other.

At least one of the high-frequency variable reactance circuit and the low-frequency variable reactance circuit may include a switch that switches between at least two states selected from a state in which an inductance is inserted, a state in which a capacitance is inserted, a state in which a combination circuit composed of an inductance and a capacitance such as a parallel resonant circuit is inserted, and a through state. The two contact terminals maintain a state of respectively being in contact with the radiating elements through their respective elastic forces.

The degree of freedom with which frequency bands covered by the antenna device can be combined can be made high by independently adjusting the reactance of the high-frequency variable reactance circuit and the reactance of the low-frequency variable reactance circuit.

Other features, elements, characteristics and advantages of the present disclosure will become more apparent from the following detailed description of preferred embodiments of the present disclosure with reference to the attached drawings.

DETAILED DESCRIPTION

[Embodiment 1]

Figure 1:
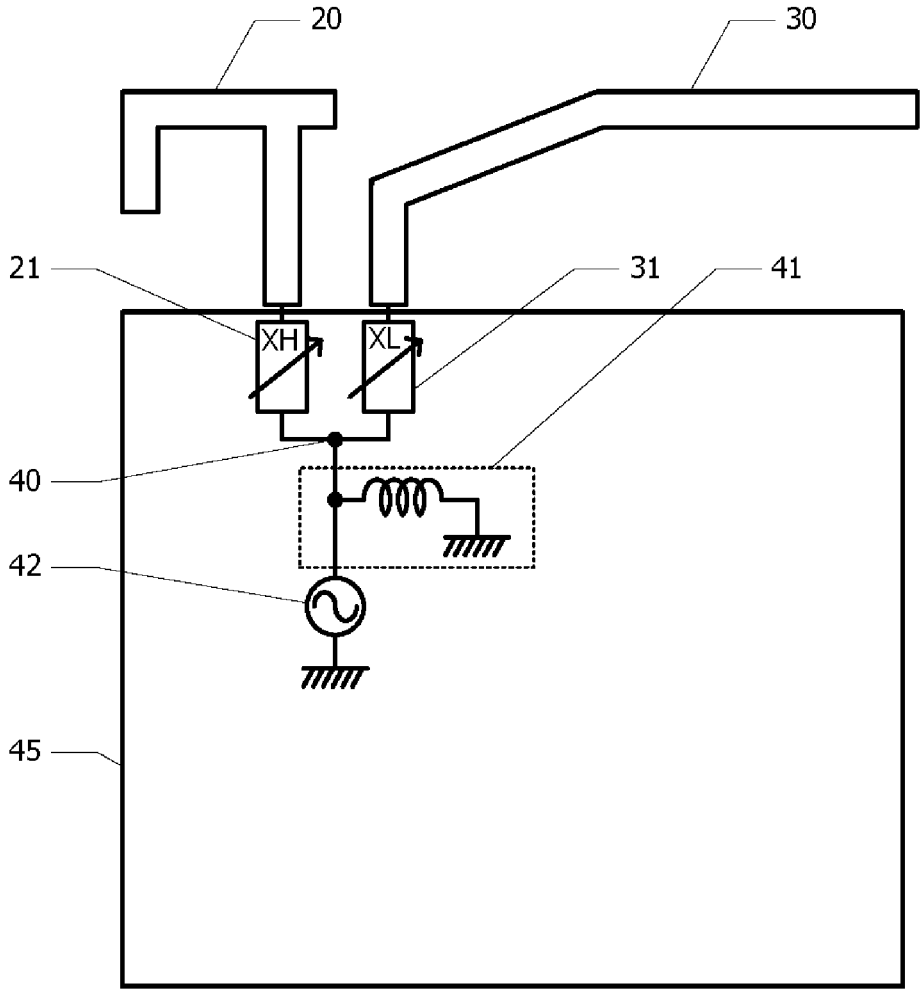
FIG. 1 is a schematic diagram of an antenna device according to Embodiment 1.

FIG. 1 illustrates a schematic diagram of an antenna device according to Embodiment 1. The antenna device according to Embodiment 1 includes a high-frequency radiating element 20 and a low-frequency radiating element 30. The high-frequency radiating element 20 and the low-frequency radiating element 30 are configured so as to operate in frequency bands that are non-contiguous with each other. That is, the operational frequency band of the high-frequency radiating element 20 is higher than the operational frequency band of the low-frequency radiating element 30. For example, the high-frequency radiating element 20 and the low-frequency radiating element 30 are monopole antennas and have different electrical lengths. The electrical length of the high-frequency radiating element 20 is shorter than the electrical length of the low-frequency radiating element 30. A ground conductor 45 is arranged for the high-frequency radiating element 20 and the low-frequency radiating element 30.

High-frequency signals output from a transmission/reception circuit 42 are branched at a branching point 40. After being branched, the high-frequency signals are respectively supplied to the high-frequency radiating element 20 and the low-frequency radiating element 30. A matching circuit 41 is inserted between the transmission/reception circuit 42 and the branching point 40. A high-frequency variable reactance circuit 21 is inserted between the branching point 40 and the high-frequency radiating element 20. A low-frequency variable reactance circuit 31 is inserted between the branching point 40 and the low-frequency radiating element 30. The matching circuit 41, the high-frequency variable reactance circuit 21 and the low-frequency variable reactance circuit 31 are arranged above the ground conductor 45. The high-frequency variable reactance circuit 21 and the low-frequency variable reactance circuit 31 are configured such that their reactances can be adjusted independently of each other. In Embodiment 1, the matching circuit 41 is formed of a shunt inductance of 10 nH.

Figure 2:
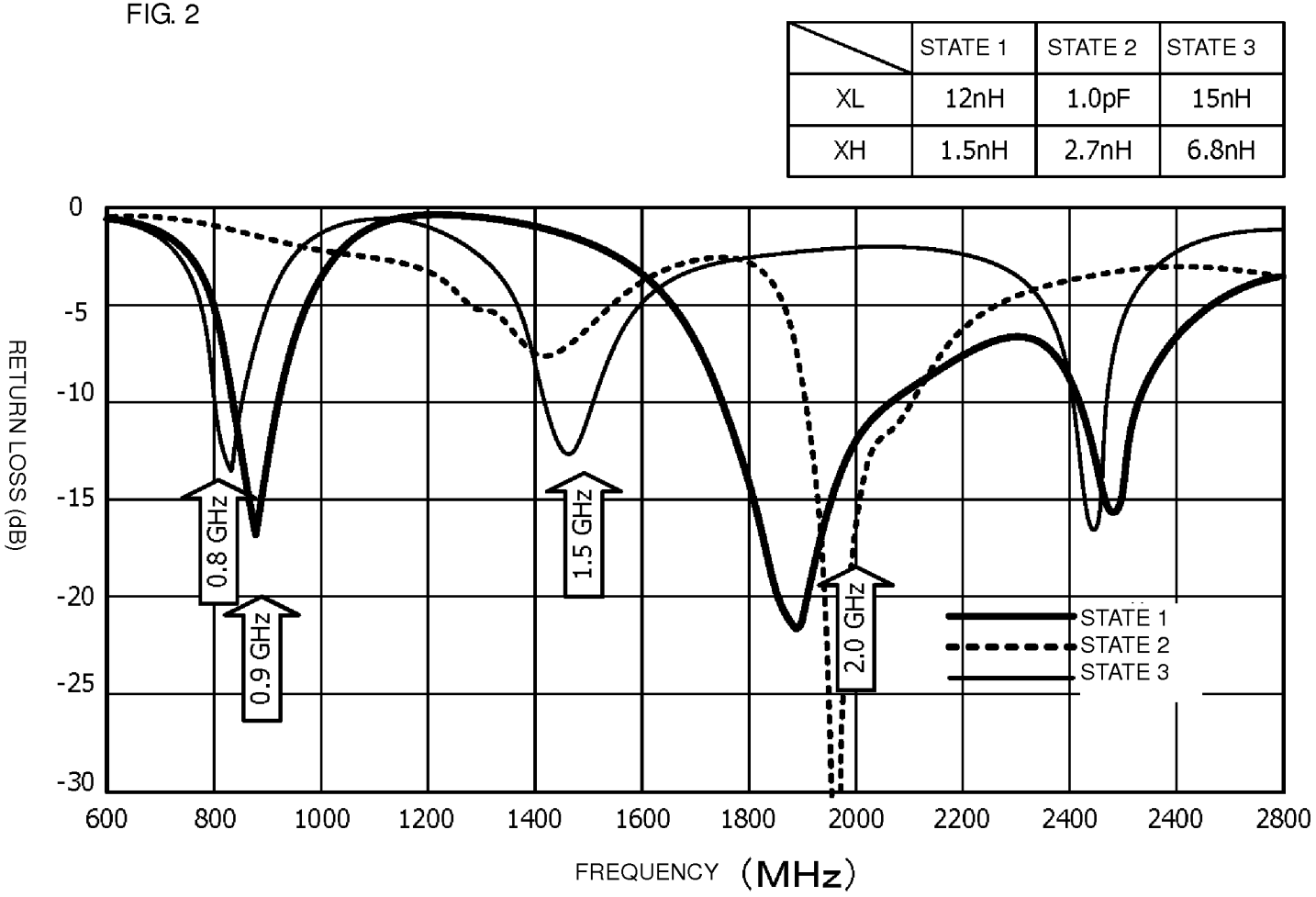
FIG. 2 is a graph illustrating the results of simulation of return loss of the antenna device according to Embodiment 1.

Results of simulation of return loss of the antenna device according to Embodiment 1 are illustrated in FIG. 2. The return loss was obtained for a case in which a reactance XL of the low-frequency variable reactance circuit 31 was 12 nH and a reactance XH of the high-frequency variable reactance circuit 21 was 1.5 nH (State 1), for a case in which in which the reactance XL of the low-frequency variable reactance circuit 31 was 1.0 pF and the reactance XH of the high-frequency variable reactance circuit 21 was 2.7 nH (State 2), and for a case in which in which the reactance XL of the low-frequency variable reactance circuit 31 was 15 nH and the reactance XH of the high-frequency variable reactance circuit 21 was 6.8 nH (State 3). The antenna device according to Embodiment 1 can be set to any of State 1, State 2 and State 3.

When the antenna device is set to State 1, the return loss has a minimum value in a low-frequency band (0.9 GHz band) and a high-frequency band (2.0 GHz band). The minimum value in the low-frequency band is due to resonance of the low-frequency radiating element 30 (FIG. 1) and the minimum value in the high-frequency band is due to resonance of the high-frequency radiating element 20 (FIG. 1). The antenna device set to State 1 can be applied to broad band communication realized using carrier aggregation in which carriers of the low-frequency band and the high-frequency band are aggregated.

When the antenna device is set to State 2, the return loss has a minimum value in a medium-frequency band (1.5 GHz band) and the high-frequency band (2.0 GHz band). This is due to the resonant frequency of the low-frequency radiating element 30 becoming higher as a result of the low-frequency variable reactance circuit 31 being capacitive. The antenna device set to State 2 can be applied to broad band communication realized using carrier aggregation in which carriers of the medium-frequency band and the high-frequency band are aggregated.

When the antenna device is set to State 3, the return loss has a minimum value in a low-frequency band (0.8 GHz band) and the medium-frequency band (1.5 GHz band). This is due to the resonant frequency of the high-frequency radiating element 20 becoming lower as a result of the inductance of the high-frequency variable reactance circuit 21 being made higher than the inductance in State 1. The antenna device set to State 3 can be applied to broad band communication realized using carrier aggregation in which carriers of the low-frequency band and the medium-frequency band are aggregated.

The transmission/reception circuit 42 has a function of carrier aggregation for at least one of a combination of a low-frequency band and a high-frequency band, a combination of a medium-frequency band and a high-frequency band and a combination of a low-frequency band and a high-frequency band.

In Embodiment 1, the combination of frequency bands that are the target of carrier aggregation can be changed by adjusting at least one of the reactance of the high-frequency variable reactance circuit 21 and the reactance of the low-frequency variable reactance circuit 31. Specifically, two frequency bands chosen from a low-frequency band, a medium frequency band and a high-frequency band can be made targets of carrier aggregation. A case can also be considered in which three radiating elements corresponding to a low-frequency band, a medium-frequency band and a high-frequency band are provided. In contrast, in Embodiment 1, there are only two radiating elements and two frequency bands that are to be targets of carrier aggregation that can be appropriately chosen from among the three frequency bands. Since the reactance of the high-frequency variable reactance circuit 21 and the reactance of the low-frequency variable reactance circuit 31 can be changed independently of each other, the degree of freedom with which frequency bands chosen as targets of carrier aggregation can be combined can be made high.

Since the degree of freedom with which frequency bands that are targets of carrier aggregation can be combined is high with the antenna device according to Embodiment 1, the antenna device can be applied to a variety of mobile wireless terminals having different operational frequency bands. The transmission/reception circuit 42 may have a carrier aggregation function for all combinations of the frequency bands or may have a carrier aggregation function for just some combinations of the frequency bands.

In addition, the effective electrical lengths of the high-frequency radiating element 20 and the low-frequency radiating element 30 can be changed independently of each other by adjusting the reactance of the high-frequency variable reactance circuit 21 and the reactance of the low-frequency variable reactance circuit 31. Therefore, the degree of freedom in designing the electrical lengths of the high-frequency radiating element 20 and the low-frequency radiating element 30 is high.

[Embodiment 2]

Figure 3:
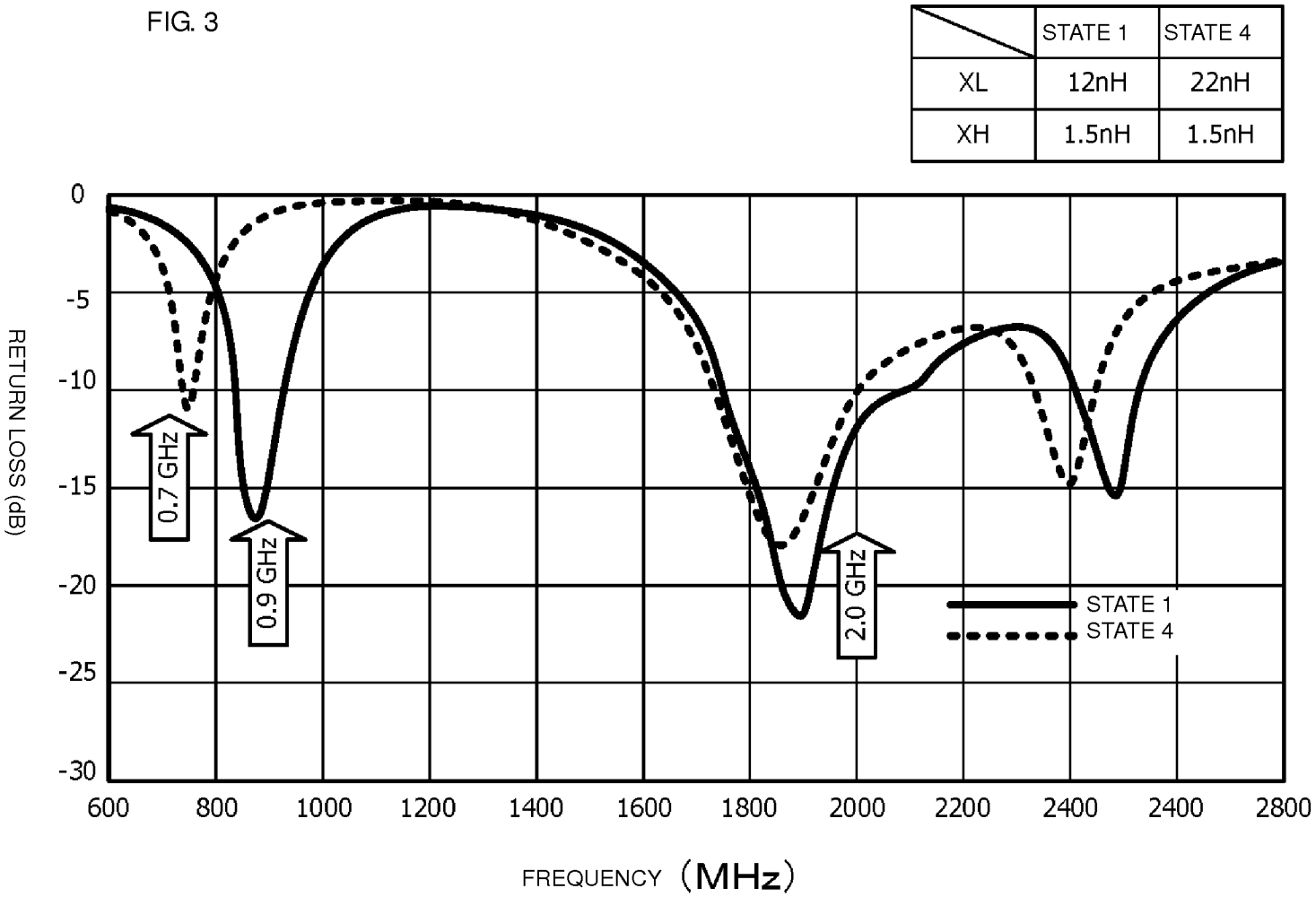
FIG. 3 is a graph illustrating the results of simulation of return loss of an antenna device according to Embodiment 2.

Results of simulation of return loss of an antenna device according to Embodiment 2 are illustrated in FIG. 3. The circuit configuration of the antenna device according to Embodiment 2 is the same as the circuit configuration of the antenna device according to Embodiment 1 (FIG. 1). In Embodiment 2, switching is performed between State 1 described in Embodiment 1 and State 4 set for the first time in Embodiment 2. In State 4, the reactance XL of the low-frequency variable reactance circuit 31 is set to 22 nH and the reactance XH of the high-frequency variable reactance circuit 21 is set to 1.5 nH.

The inductance of the low-frequency variable reactance circuit 31 of the antenna device set to State 4 is higher than the inductance of the low-frequency variable reactance circuit 31 of the antenna device set to State 1. As a result, the resonant frequency of the low-frequency radiating element 30 (FIG. 1) in State 4 is lower than the resonant frequency in State 1.

The antenna device according to Embodiment 2 is capable of handling both broad band communication achieved using carrier aggregation in which a low-frequency band and a high-frequency band are combined and communication in which a third frequency band (0.7 GHz band) different from the low-frequency band and the high-frequency band is used independently.

[Embodiment 3]

Figure 4:
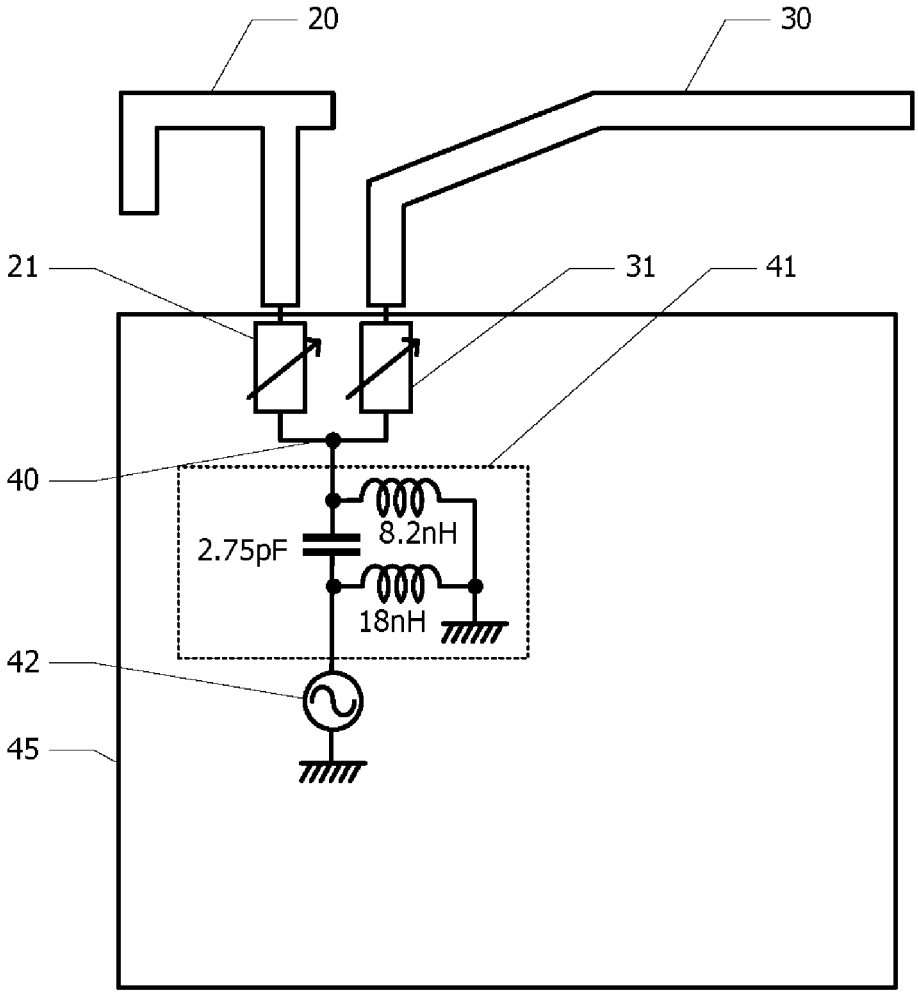
FIG. 4 is a schematic diagram of an antenna device according to Embodiment 3.

FIG. 4 illustrates a schematic diagram of an antenna device according to Embodiment 3. In Embodiment 1, the matching circuit 41 (FIG. 1) is formed of a shunt inductance. In Embodiment 3, the matching circuit 41 is formed of a π circuit composed of a series capacitance and two shunt inductances. The rest of the configuration is the same as that of the antenna device according to Embodiment 1.

As an example, a series capacitance of 2.75 pF is included in the matching circuit 41. The shunt inductance on the transmission/reception circuit 42 side is 18 nH and the shunt inductance on the radiating element side is 8.2 nH. The matching circuit 41 causes plural resonances to be generated by the low-frequency radiating element 30.

Figure 5:
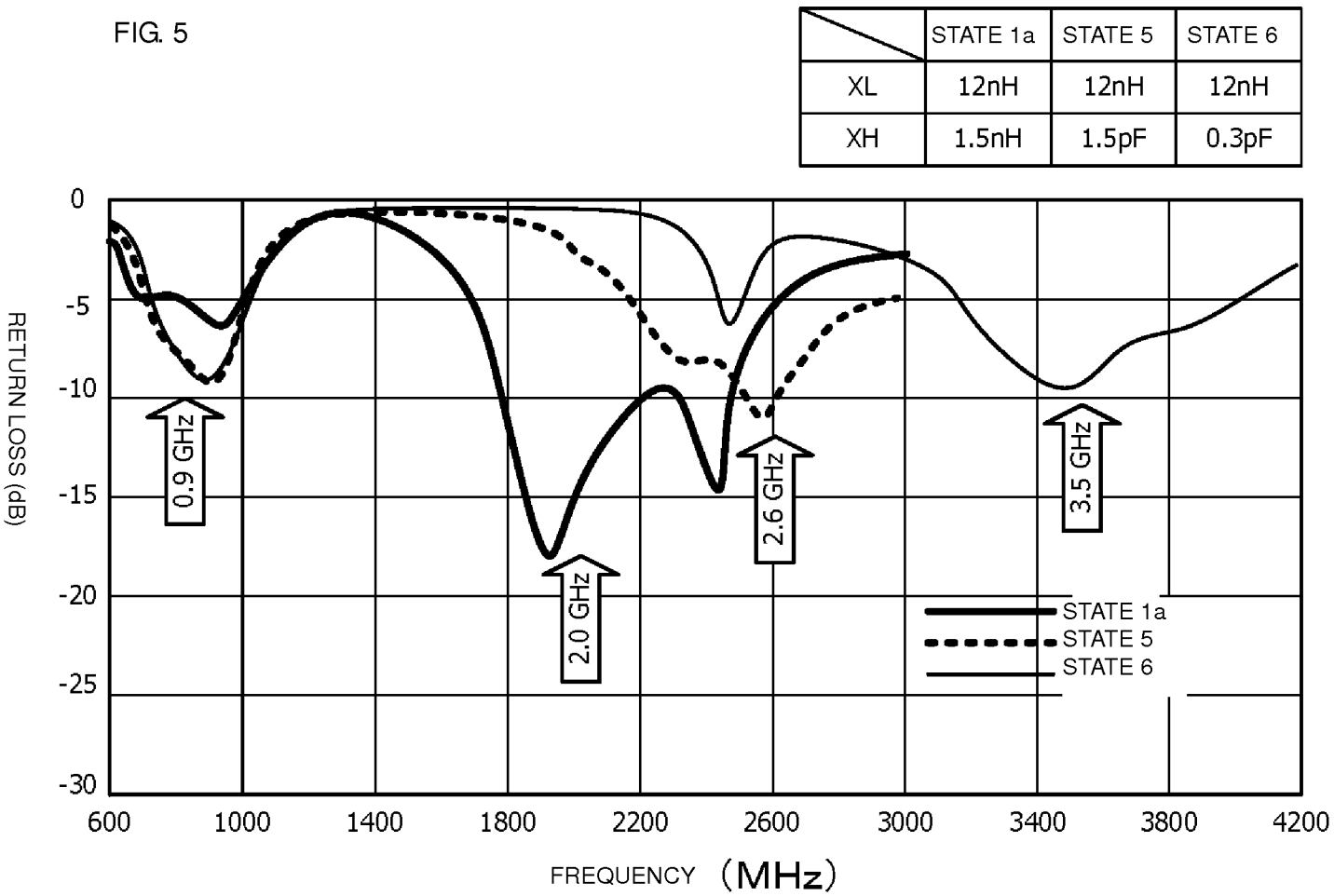
FIG. 5 is a graph illustrating the results of simulation of return loss of the antenna device according to Embodiment 3.

Results of simulation of return loss of the antenna device according to Embodiment 3 are illustrated in FIG. 5. In the antenna device according to Embodiment 3, switching is performed between State 1*a*, State 5 and State 6. In State 1*a*, the reactance XL of the low-frequency variable reactance circuit 31 is set to 12 nH and the reactance XH of the high-frequency variable reactance circuit 21 is set to 1.5 nH. These reactances are the same as the reactances in State 1 in Embodiment 1. Comparing the return loss in State 1 of Embodiment 1 (FIG. 2) and the return loss in State 1*a* of Embodiment 3 (FIG. 5), it is clear that, in the low-frequency band, the valley of the return loss in Embodiment 3 is broader than the valley of the return loss in Embodiment 1. This is caused by the plural resonances being generated by the low-frequency radiating element 30 due to the matching circuit 41. Thus, the operational frequency band in the low-frequency band can be made broader by the generation of plural resonances by the low-frequency radiating element 30.

In State 5, the reactance XL of the low-frequency variable reactance circuit 31 is set to 12 nH and the reactance XH of the high-frequency variable reactance circuit 21 is set to 1.5 pF. In State 6, the reactance XL of the low-frequency variable reactance circuit 31 is set to 12 nH and the reactance XH of the high-frequency variable reactance circuit 21 is set to 0.3 pF.

In States 5 and 6, since the high-frequency variable reactance circuit 21 is capacitive, the effective electrical length of the high-frequency radiating element 20 (FIG. 4) is short and the resonant frequency of the high-frequency radiating element 20 is high. Therefore, a high-frequency band in which the return loss has a minimum value is shifted toward the higher side from the 2.0 GHz band to the 2.6 GHz band or the 3.5 GHz band. The peak that appears in the vicinity of 2.4 GHz is caused by a higher-order mode resonance of the low-frequency radiating element 30.

The antenna device according to Embodiment 3, by switching between State 1*a*, State 5 and State 6, can handle broad band communication achieved using carrier aggregation in which a low-frequency band (0.9 GHz band) and a high-frequency band (2.0 GHz band) are combined and communication in which a third frequency band (2.6 GHz band or 3.5 GHz band) different from the low-frequency band and the high-frequency band is used.

Figure 6:
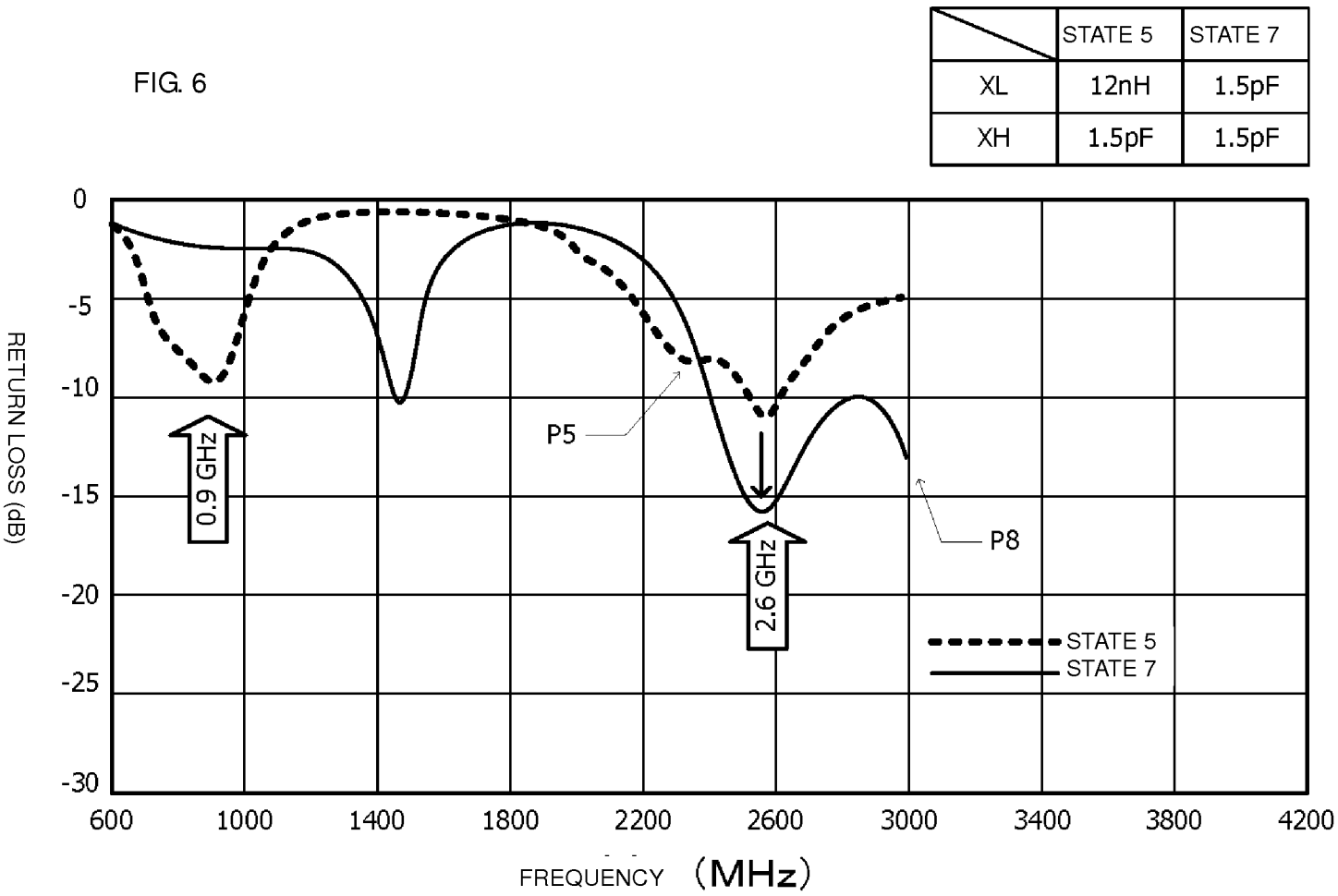
FIG. 6 is a graph illustrating the results of simulation of return loss of the antenna device according to Embodiment 3.

Results of simulation of return loss under State 5 and State 7 for the antenna device according to Embodiment 3 are illustrated in FIG. 6. In State 7, the reactance XL of the low-frequency variable reactance circuit 31 and the reactance XH of the high-frequency variable reactance circuit 21 are both set to 1.5 pF. In State 7, the peak caused by the resonance of the low-frequency radiating element 30 is shifted toward the high-frequency side from the peak in State 5 due to the low-frequency variable reactance circuit 31 being capacitive.

In State 5, a peak P5 caused by higher-order mode resonance of the low-frequency radiating element 30 appears in the vicinity of a peak caused by resonance of the high-frequency radiating element 20. The anti-resonance point of the higher-order mode of the low-frequency radiating element 30 may have an adverse affect on the antenna characteristics in the 2.6 GHz band, which is the operational frequency band of the high-frequency radiating element 20.

In State 7, the resonant frequency of the low-frequency radiating element 30 is set to be high and therefore the resonant frequency of the higher-order mode is also high. Thus, a peak P8 caused by the resonance of the higher-order mode of the low-frequency radiating element 30 can be kept distant from the operational frequency band (2.6 GHz band) of the high-frequency radiating element 20. Therefore, the antenna characteristics in the operational frequency band of the high-frequency radiating element 20 are negligibly affected by the higher-order resonant mode of the low-frequency radiating element 30. As a result, the return loss in State 7 is lower than the return loss in State 5 in the operational frequency band of the high-frequency radiating element 20. When the operational frequency band of the high-frequency radiating element 20 is to be adjusted, good antenna characteristics can be obtained in the high-frequency band by adjusting the reactance XL of the low-frequency variable reactance circuit 31 corresponding to the low-frequency radiating element 30, that is, the other radiating element.

[Embodiment 4]

Figure 7:
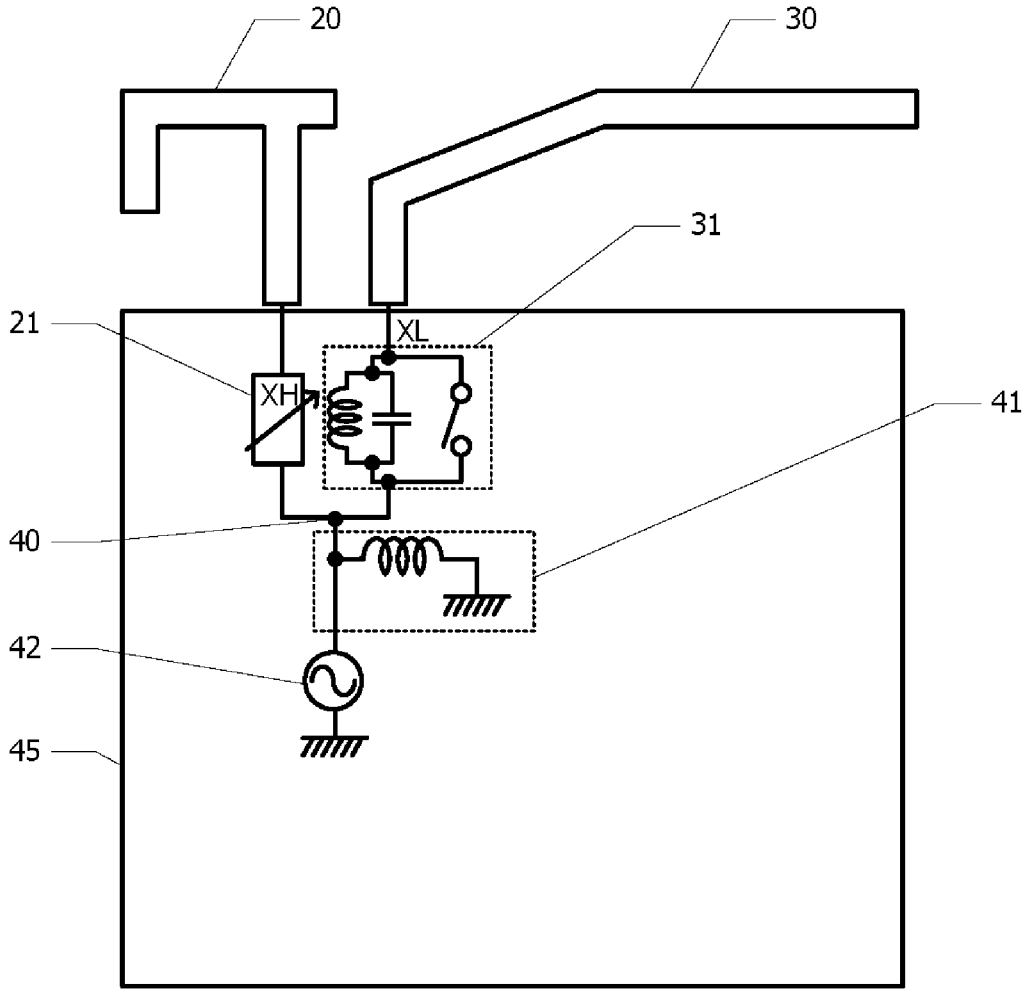
FIG. 7 is a schematic diagram of an antenna device according to Embodiment 4.

FIG. 7 illustrates a schematic diagram of an antenna device according to Embodiment 4. In Embodiment 1, the high-frequency variable reactance circuit 21 and the low-frequency variable reactance circuit 31 are formed of a series inductance or a series capacitance. In Embodiment 4, the low-frequency variable reactance circuit 31 includes a parallel resonant circuit formed of an inductance and a capacitance. This parallel resonant circuit is inserted in series with the low-frequency radiating element 30. The inductance and the capacitance that form the parallel resonant circuit of the low-frequency variable reactance circuit 31 have values of 8.2 nH and 0.6 pF, respectively.

In addition, the low-frequency variable reactance circuit 31 includes a switch for bypassing the parallel resonant circuit. By switching this switch on and off, a through state (State 8) and a state in which the parallel resonant circuit is inserted in series with the low-frequency radiating element 30 (State 9) can be switched between. In State 8, the reactance of the low-frequency variable reactance circuit 31 is 0Ω. The rest of the configuration is the same as that of the antenna device according to Embodiment 1.

In both State 8 and State 9, the high-frequency variable reactance circuit 21 is in a through state, that is, a state in which the reactance is 0Ω. The matching circuit 41 is formed of a shunt inductance of 8.2 nH.

Figure 8:
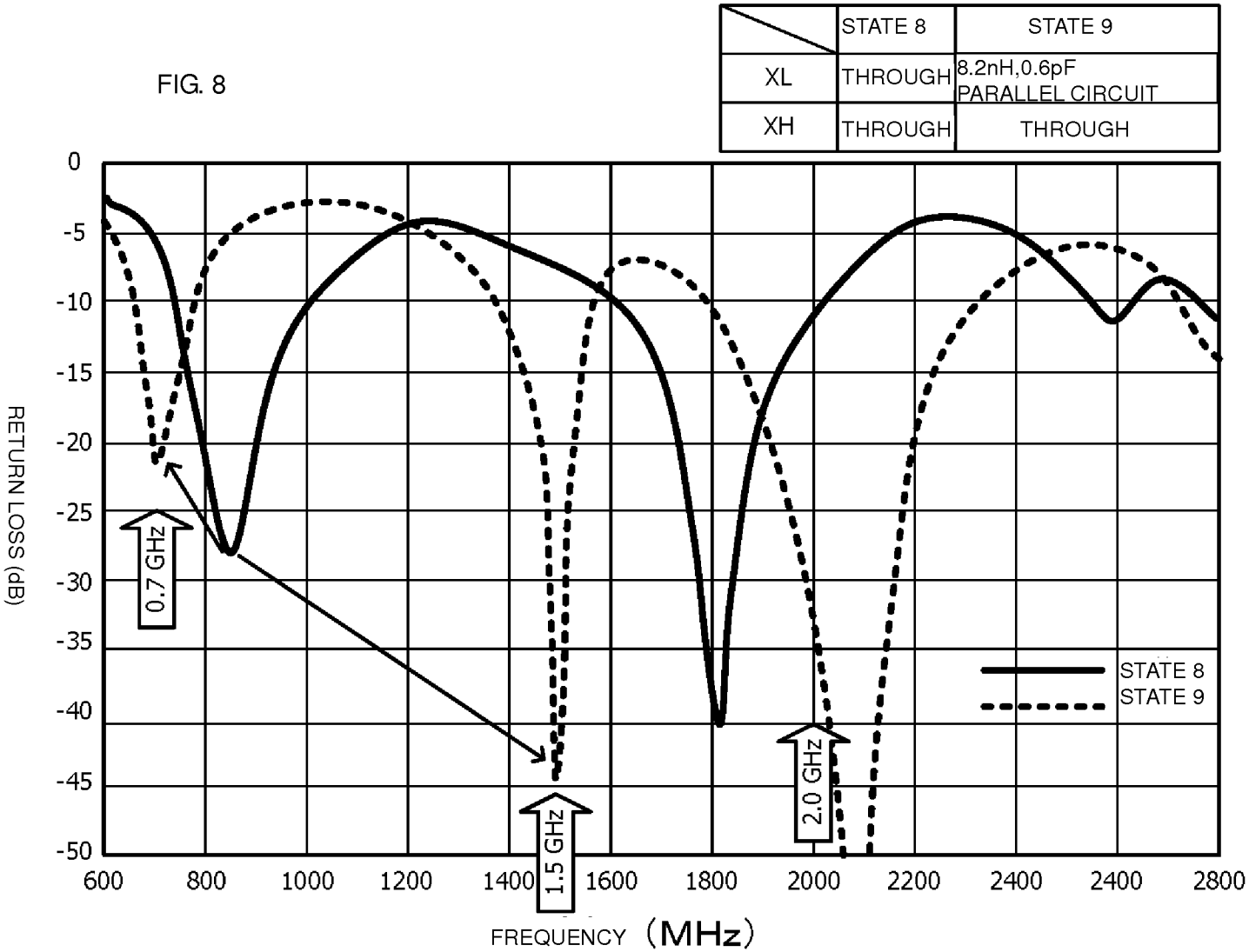
FIG. 8 is a graph illustrating the results of simulation of return loss of the antenna device according to Embodiment 4.

Results of simulation of return loss in State 8 and State 9 for the antenna device according to Embodiment 4 are illustrated in FIG. 8. In State 8, the return loss has a minimum value in the 0.8 GHz band due to resonance of the low-frequency radiating element 30 and the return loss has a minimum value in the 1.8 GHz band due to resonance of the high-frequency radiating element 20. In State 9, a dual resonance of the low-frequency radiating element 30 is generated as a result of the insertion of the parallel resonant circuit in the low-frequency variable reactance circuit 31. Thus, the return loss has a minimum value in the 0.7 GHz band and the 1.5 GHz band.

The antenna device according to Embodiment 4 can be applied to broad band communication achieved using carrier aggregation in which the 0.8 GHz band and the 1.8 GHz band are combined in State 8. In addition, in State 9, the antenna device can be applied to broad band communication achieved using carrier aggregation in which a medium frequency band (1.5 GHz band) and a high-frequency band (2.0 GHz band) are combined. In addition, in State 9, communication utilizing the 0.7 GHz band is also possible.

As in Embodiment 4, use of a greater variety of combinations of frequency bands is possible by configuring the low-frequency variable reactance circuit 31 to include a parallel resonant circuit formed of an inductance and a capacitance. In addition, the high-frequency variable reactance circuit 21 may also include a parallel resonant circuit formed of an inductance and a capacitance. In addition, not limited to a parallel resonant circuit, more generally, at least one of the high-frequency variable reactance circuit 21 and the low-frequency variable reactance circuit 31 may be formed as a combination circuit in which an inductance and a capacitance are combined with each other.

[Embodiment 5]

Figure 9:
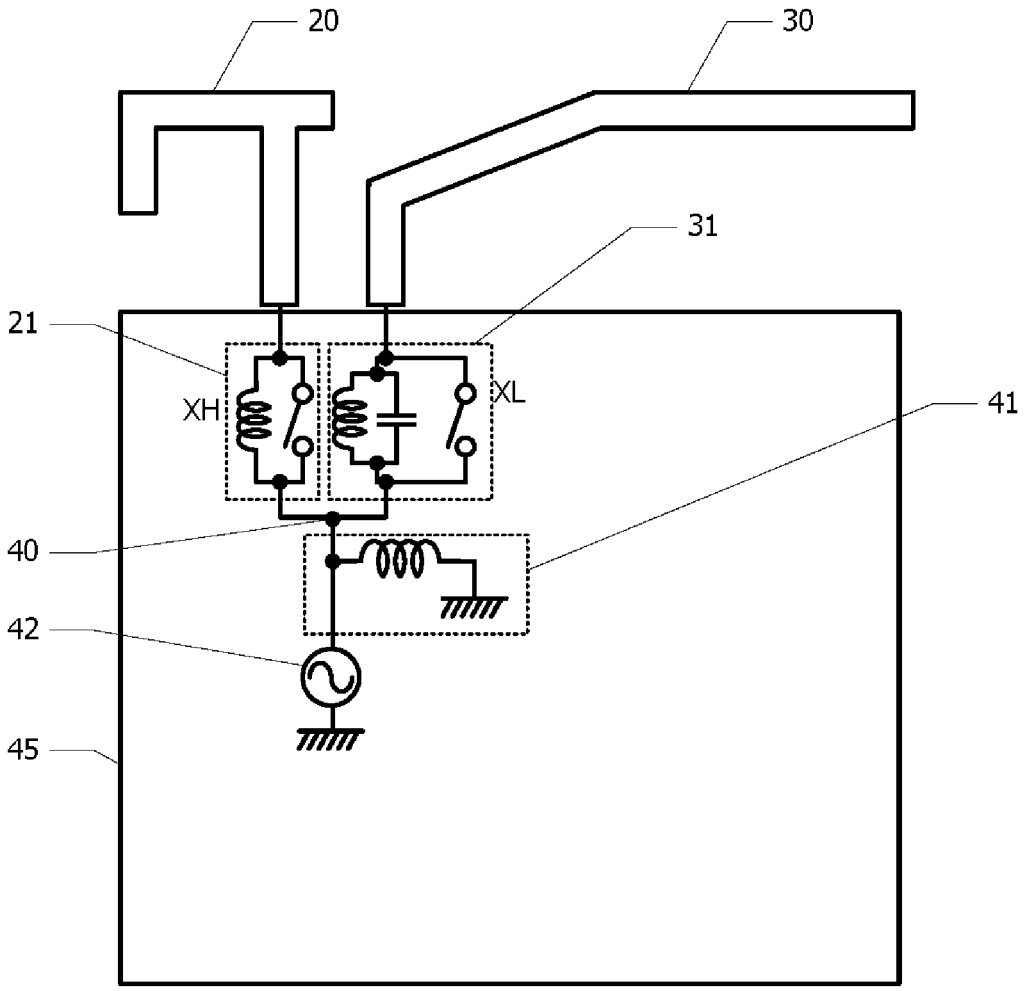
FIG. 9 is a schematic diagram of an antenna device according to Embodiment 5.

FIG. 9 illustrates a schematic diagram of an antenna device according to Embodiment 5. In Embodiment 4, the high-frequency variable reactance circuit 21 was made to operate in a through state. In Embodiment 5, the high-frequency variable reactance circuit 21 is formed of a series inductance of 3.3 nH and a by-pass switch. The rest of the configuration is the same as that of the antenna device according to Embodiment 4 (FIG. 7).

When the high-frequency variable reactance circuit 21 and the low-frequency variable reactance circuit 31 are both in a through state, a state the same as State 8 of Embodiment 4 is implemented. The antenna device according to Embodiment 5 can be further set to State 10. In State 10, the switch of the high-frequency variable reactance circuit 21 and the switch of the low-frequency variable reactance circuit 31 are both switched to off. Due to this, an inductance of 3.3 nH is inserted in series with the high-frequency radiating element 20 and a parallel resonant circuit is inserted in series with the low-frequency radiating element 30. The circuit constant of the parallel resonant circuit is the same as the circuit constant of the parallel resonant circuit of the low-frequency variable reactance circuit 31 of Embodiment 4.

Figure 10:
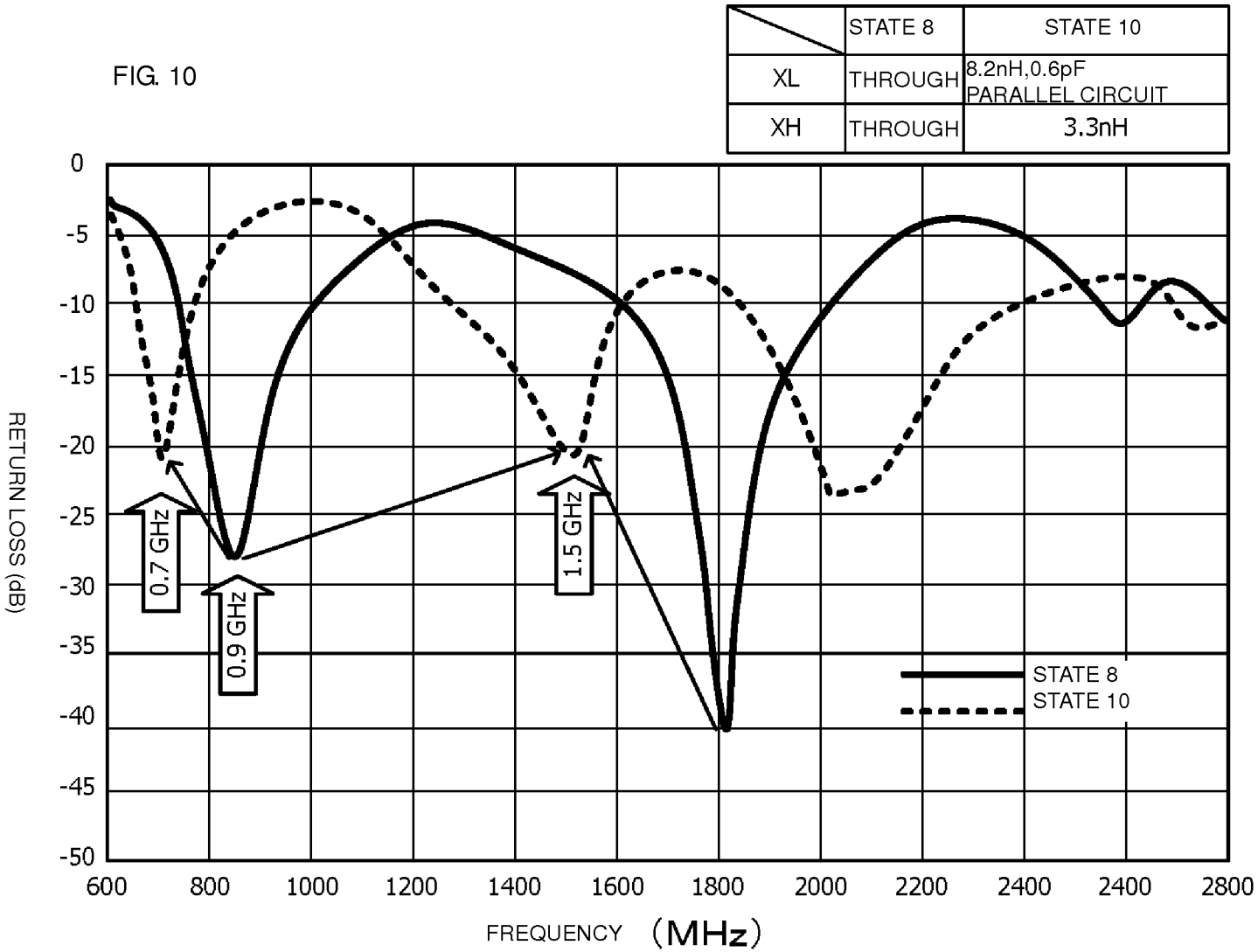
FIG. 10 is a graph illustrating the results of simulation of return loss of the antenna device according to Embodiment 5.

Results of simulation of return loss in State 8 and State 10 for the antenna device according to Embodiment 5 are illustrated in FIG. 10. In State 10, similarly to State 9 of Embodiment 4 (FIG. 8), a dual resonance of the low-frequency radiating element 30 is generated and the return loss has a minimum value in the 0.7 GHz band and the 1.5 GHz band. In addition, the resonant frequency is lowered by insertion of the reactance in series with the high-frequency radiating element 20. Thus, one of the dual resonance of the low-frequency radiating element 30 and the resonance of the high-frequency radiating element 20 overlap in the 1.5 GHz band.

In Embodiment 5, both the high-frequency radiating element 20 and the low-frequency radiating element 30 can be utilized in communication in a third frequency band (1.5 GHz band) that is different from the low-frequency band and the high-frequency band. In the case where it would be advantageous in improving the gain, State 10 may be actively used.

[Embodiment 6]

Figure 11:
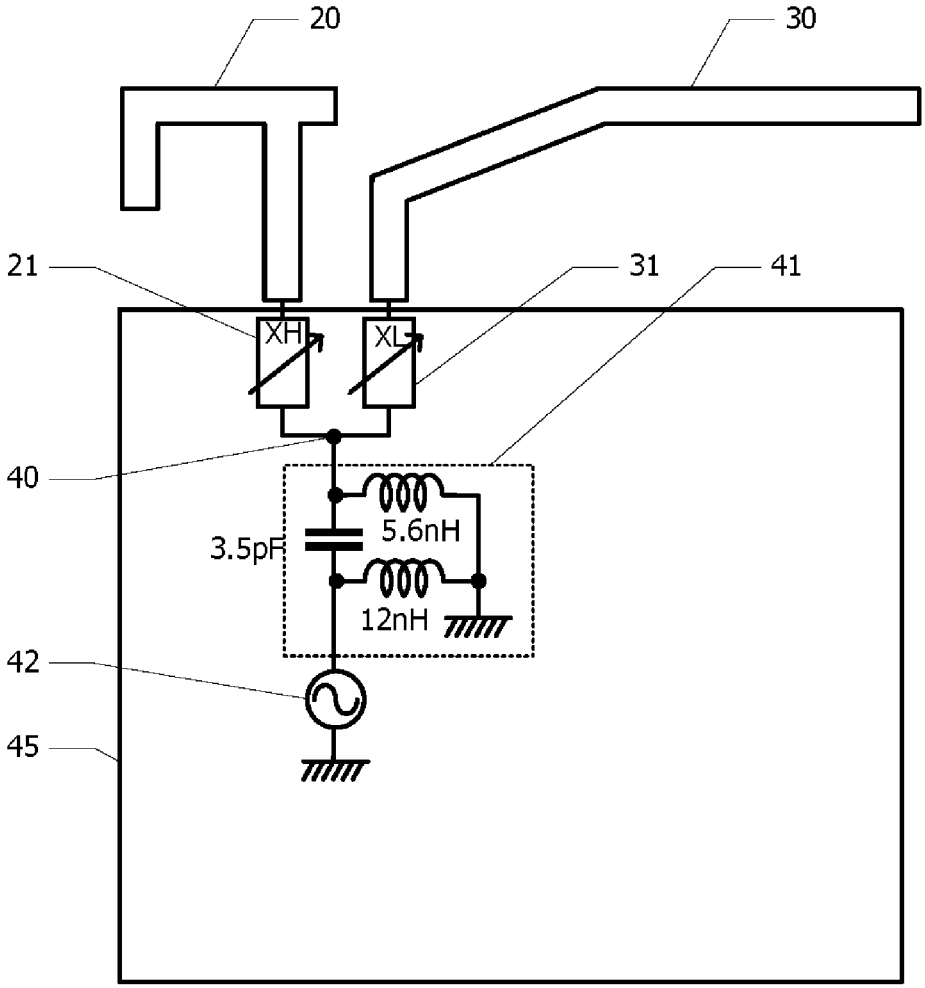
FIG. 11 is a schematic diagram of an antenna device according to Embodiment 6.

FIG. 11 illustrates a schematic diagram of an antenna device according to Embodiment 6. The matching circuit 41 of the antenna device according to Embodiment 6, similarly to the matching circuit 41 of the antenna device according to Embodiment 3 (FIG. 4), includes a π circuit composed of two shunt inductances and a single series capacitance. The shunt inductance on the transmission/reception circuit 42 side is 12 nH and the shunt inductance on the radiating element side is 5.6 nH. The series capacitance is 3.5 pF. Plural resonances are generated by the matching circuit 41 and the low-frequency radiating element 30.

In Embodiment 6, State 1*b*, State 11, State 12 and State 13 are implemented by changing the reactances of the low-frequency variable reactance circuit 31 and the high-frequency variable reactance circuit 21. In State 1*b*, the reactance XL of the low-frequency variable reactance circuit 31 is set to 14 nH and the reactance XH of the high-frequency variable reactance circuit 21 is set to 1.5 nH. In State 11, the reactance XL is set to 1.5 pF and the reactance XH is set to 2.7 nH. In State 12, the reactance XL is set to 14 nH and the reactance XH is set to 8.2 nH. In State 13, the reactance XL is set to 20 nH and the reactance XH is set to 1.5 nH.

Figure 12:
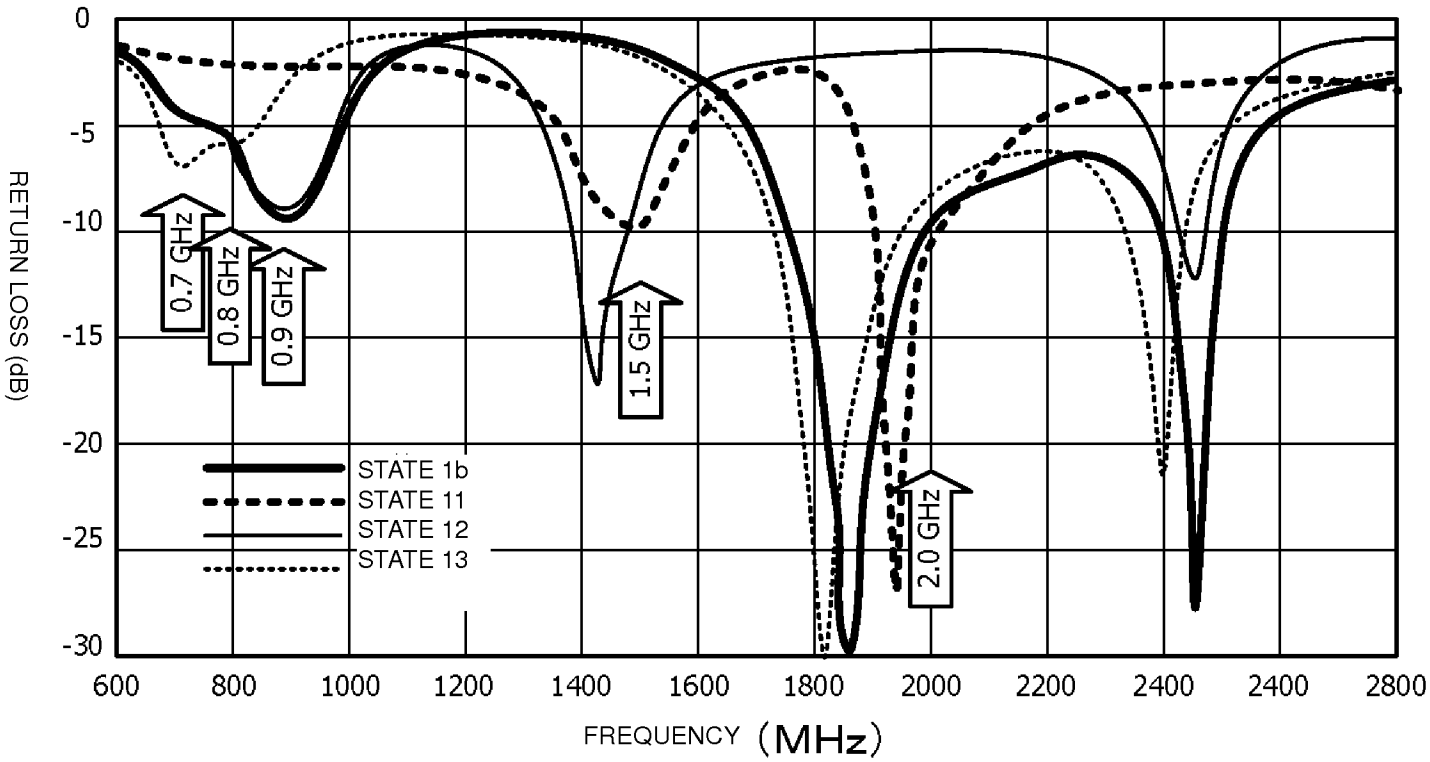
FIG. 12 is a graph illustrating the results of simulation of return loss of the antenna device according to Embodiment 6.

Results of simulation of return loss in State 1*b*, State 11, State 12 and State 13 for the antenna device according to Embodiment 6 are illustrated in FIG. 12. The antenna device set to State 1*b* can be applied to broad band communication achieved using carrier aggregation in which a low-frequency band (0.8 GHz to 0.9 GHz) and a high-frequency band (2.0 GHz) are combined. The antenna device set to State 11 can be applied to broad band communication achieved using carrier aggregation in which a medium-frequency band (1.5 GHz) and the high-frequency band are combined. The antenna device set to State 12 can be applied to broad band communication achieved using carrier aggregation in which the low-frequency band (0.8 GHz to 0.9 GHz) and the medium-frequency band (1.5 GHz) are combined. Since plural resonances are generated in the low-frequency band, the bandwidth of the low-frequency band is broader than in the case of State 1 of Embodiment 1 (FIG. 2).

Thus, the antenna device according to Embodiment 6 can handle carrier aggregation in which carriers of desired frequency bands are aggregated similarly to Embodiment 1 by independently adjusting the reactance of the low-frequency variable reactance circuit 31 and the reactance of the high-frequency variable reactance circuit 21.

The reactance XL of the low-frequency variable reactance circuit 31 set to State 13 is larger than the reactances XL of the low-frequency variable reactance circuit 31 set to State 1*b* and State 12. Thus, the frequency band in which the return loss takes a minimum value is lowered to the 0.7 GHz band from the 0.8 to 0.9 GHz band. Since plural resonances are generated for the low-frequency radiating element 30, a broader bandwidth can be secured also in the 0.7 GHz band compared with State 4 of Embodiment 2 (FIG. 3).

[Embodiment 7]

Figure 13:
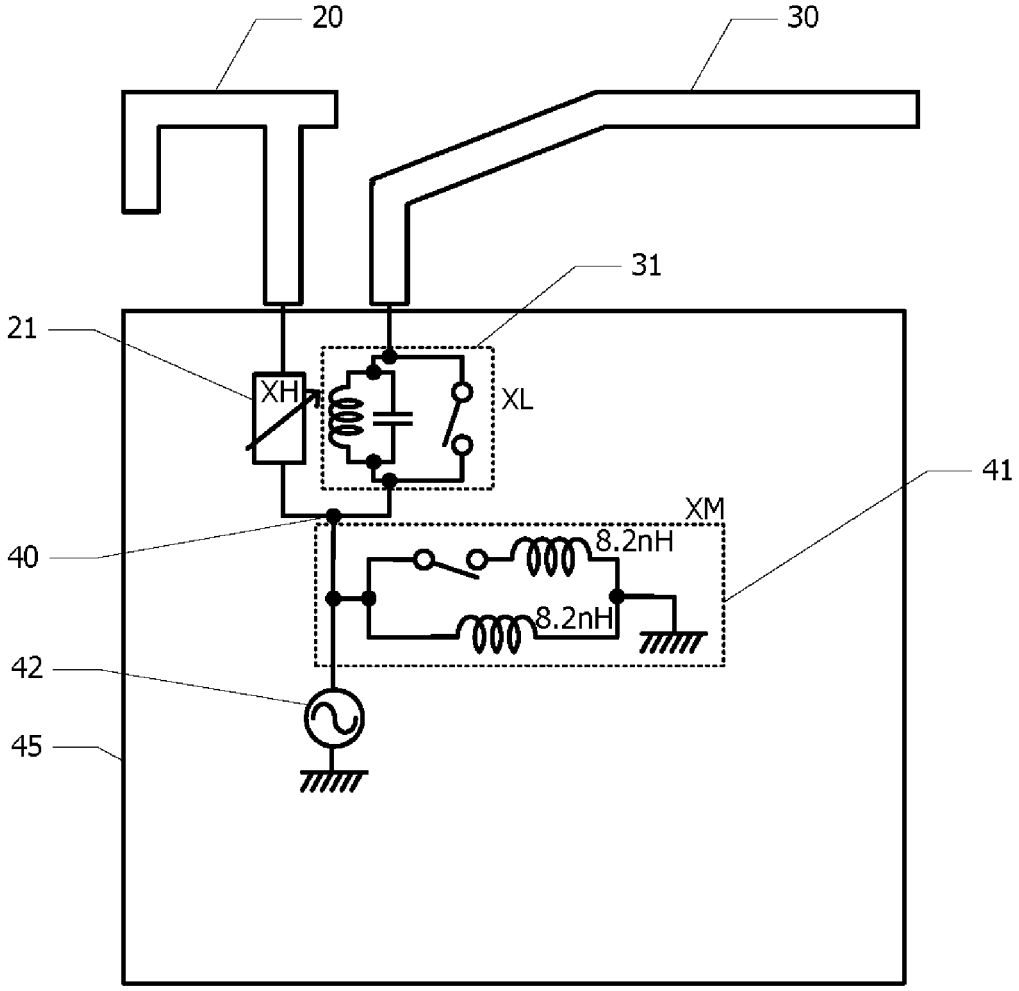
FIG. 13 is a schematic diagram of an antenna device according to Embodiment 7.

FIG. 13 illustrates a schematic diagram of an antenna device according to Embodiment 7. In Embodiment 7, the reactance of the matching circuit 41 is variable. For example, the matching circuit 41 is formed of a variable reactance shunt inductance. More specifically, the shunt inductance is formed of two inductances of 8.2 nH connected in parallel with each other. A switch is connected in series with one of the inductances. A shunt inductance XM of the matching circuit 41 is 8.2 nH when the switch is off and 4.1 nH when the switch is on.

The configurations of the low-frequency variable reactance circuit 31 and the high-frequency variable reactance circuit 21 are the same as those of the low-frequency variable reactance circuit 31 and the high-frequency variable reactance circuit 21 according to Embodiment 4 (FIG. 7).

In Embodiment 7, State 8 and State 14 are realized by changing the reactance of the matching circuit 41. In both State 8 and State 14, the low-frequency variable reactance circuit 31 and the high-frequency variable reactance circuit 21 are set to a through state. In State 8, the shunt inductance of the matching circuit 41 is set to 8.2 nH. In State 14, the shunt inductance of the matching circuit 41 is set to 4.1 nH.

Figure 14:
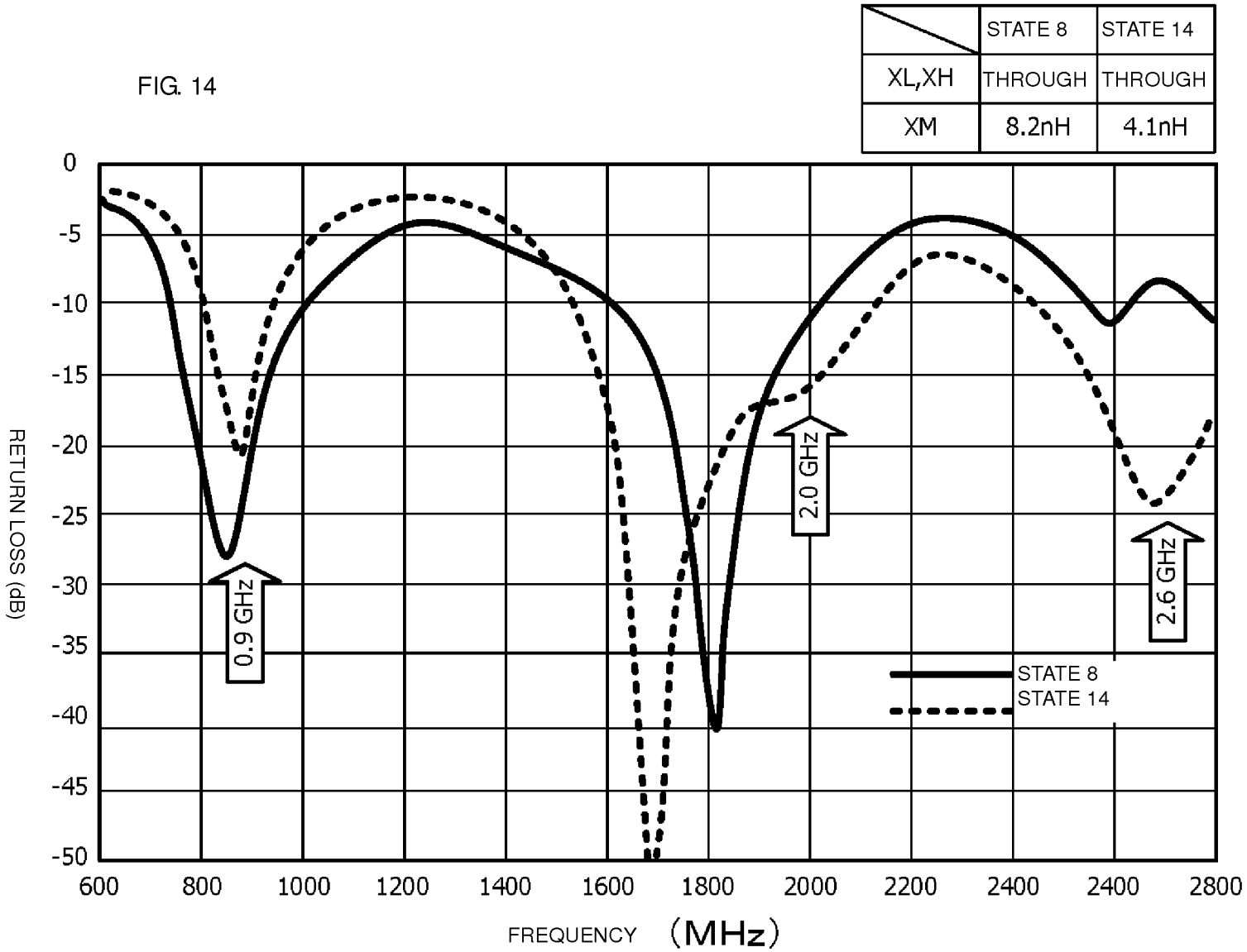
FIG. 14 is a graph illustrating the results of simulation of return loss of the antenna device according to Embodiment 7.

Results of simulation of return loss in State 8 and State 14 for the antenna device according to Embodiment 7 are illustrated in FIG. 14. State 8 of Embodiment 7 is the same as State 8 of Embodiment 4 (FIG. 8). The return loss in the 2.6 GHz band is lower in State 14 than in State 8. Thus, matching can also be optimized in a frequency band (2.6 GHz band) outside of the frequency bands that are targets of carrier aggregation (0.9 GHz band and 2.0 GHz band) by adjusting the reactance of the matching circuit 41.

[Embodiment 8]

Figure 15:
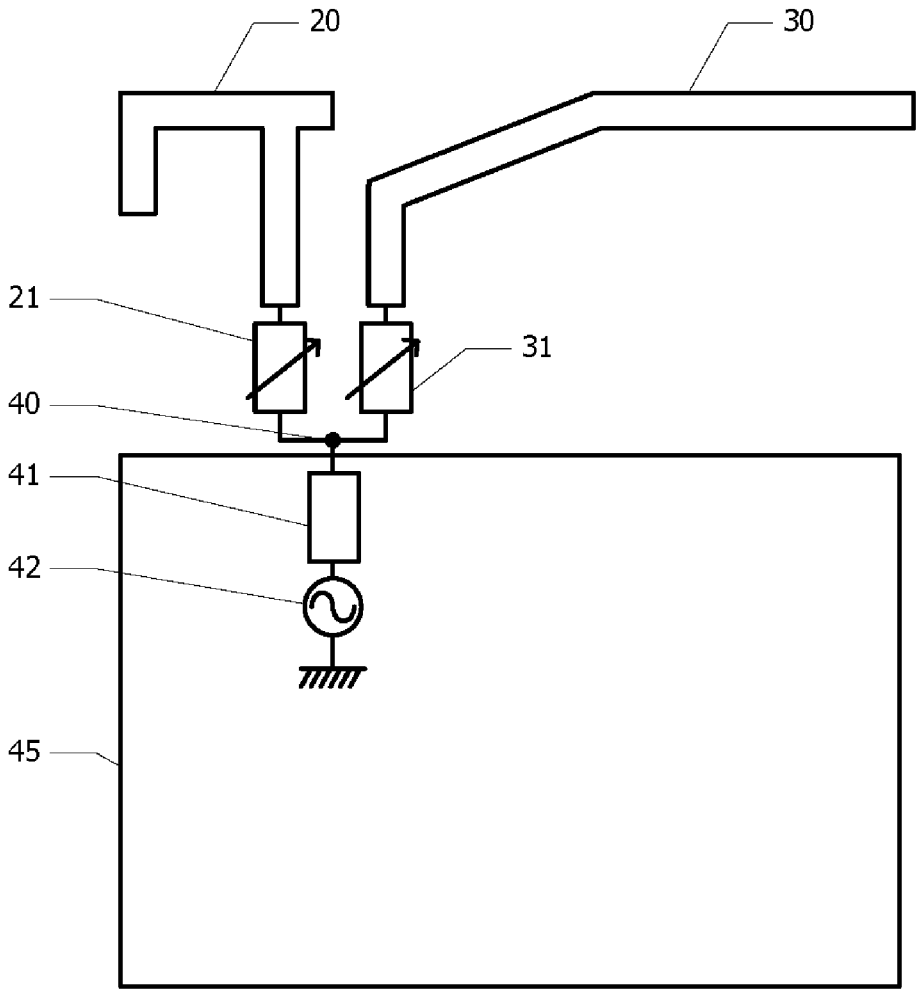
FIG. 15 is a schematic diagram of an antenna device according to Embodiment 8.

FIG. 15 illustrates a schematic diagram of an antenna device according to Embodiment 8. In Embodiments 1 to 7, the high-frequency variable reactance circuit 21, the low-frequency variable reactance circuit 31 and the matching circuit 41 are arranged above the ground conductor 45 (at positions that are superposed with ground conductor 45 when viewed in plan). In Embodiment 8, the matching circuit 41 is arranged above the ground conductor 45, but the high-frequency variable reactance circuit 21 and the low-frequency variable reactance circuit 31 are arranged at positions spaced away from the ground conductor 45 (at positions that are not superposed with the ground conductor 45 when viewed in plan).

In Embodiment 8, stray capacitances between the high-frequency variable reactance circuit 21 and the ground conductor 45 and between the low-frequency variable reactance circuit 31 and the ground conductor 45 are reduced. Therefore, restrictions on the values of the reactances of the high-frequency variable reactance circuit 21 and the low-frequency variable reactance circuit 31 are lightened. Thus, the reactances of the high-frequency variable reactance circuit 21 and the low-frequency variable reactance circuit 31 can be changed over a wide range.

[Embodiment 9]

In Embodiment 9, a specific example of a circuit configuration of the high-frequency variable reactance circuit 21 and the low-frequency variable reactance circuit 31 used in the antenna devices according to Embodiments 1 to 7 is described.

Figure 16B:
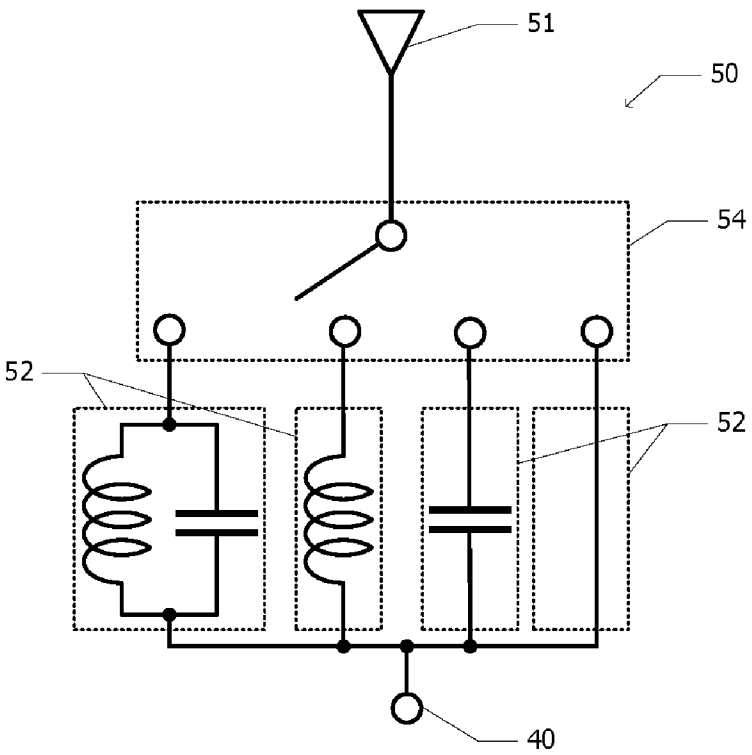
FIGS. 16A and 16B are equivalent circuit diagrams of a variable reactance circuit of an antenna device according to Embodiment 9.
Figure 16A:
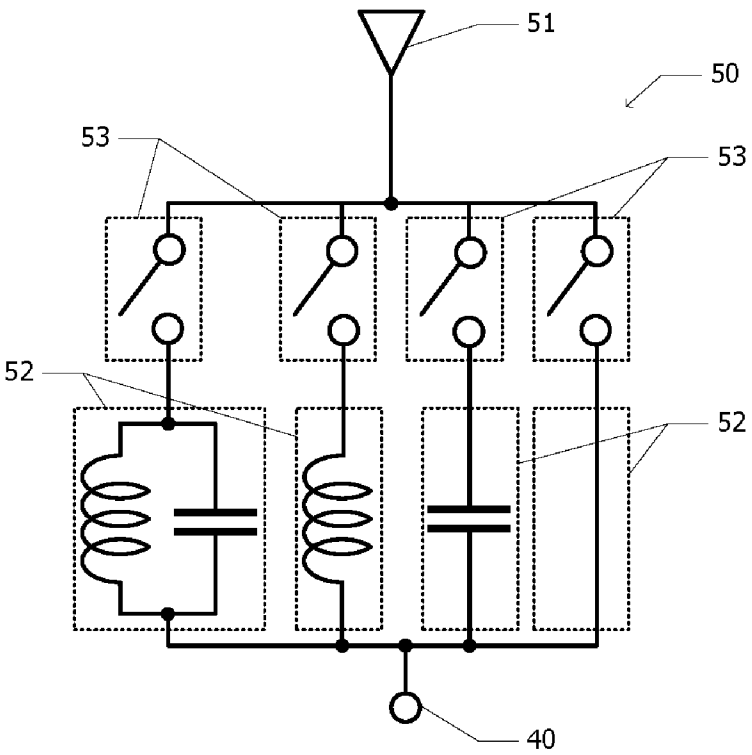

An equivalent circuit diagram of a variable reactance circuit 50 according to Embodiment 9 is illustrated in FIG. 16A. The variable reactance circuit 50 corresponds to the high-frequency variable reactance circuit 21 or the low-frequency variable reactance circuit 31 used in the antenna devices according to Embodiments 1 to 7. The variable reactance circuit 50 is inserted between the branching point 40 (refer to, for example, FIG. 1) and a radiating element 51. The radiating element 51 corresponds to the high-frequency radiating element 20 or the low-frequency radiating element 30 (refer to, for example, FIG. 1) of the antenna devices according to Embodiments 1 to 7.

A plurality of reactance elements 52, which are connected in parallel with one another, are inserted between the branching point 40 and the radiating element 51. A single pole single throw (spst) switch 53 is connected in series with each reactance element 52. For example, an inductance, a capacitance, a combination circuit composed of an inductance and a capacitance (for example, a parallel resonant circuit), a through line and so forth are used as the reactance elements 52. The reactance of the variable reactance circuit 50 can be changed by switching the single pole single throw switches 53 on and off. As illustrated in FIG. 16B, a single pole multiple throw (spmt) switch 54 may be used instead of the single pole single throw switches 53.

A large change in reactance can be realized by switching between the plurality of reactance elements 52 of the variable reactance circuit 50 using the single pole single throw switches 53 or the single pole multiple throw switch 54. In addition, the degree of freedom with which the reactance can be designed is made high.

[Embodiment 10]

Figure 17A:
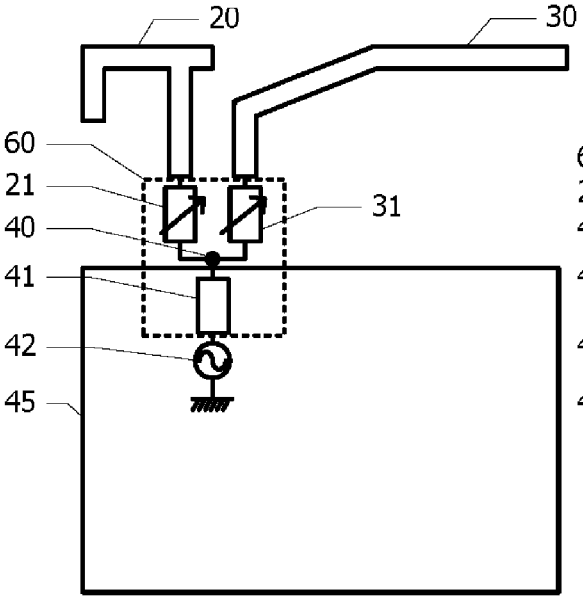
FIGS. 17A to 17C are schematic diagrams of an antenna device according to Embodiment 10.
Figure 17B:
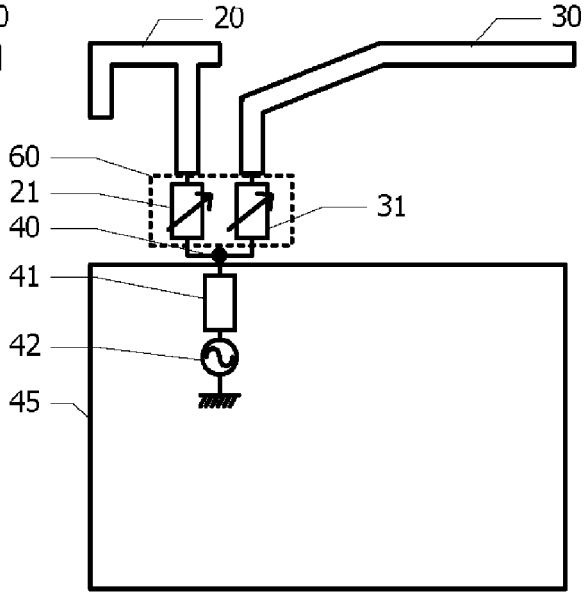
Figure 17C:
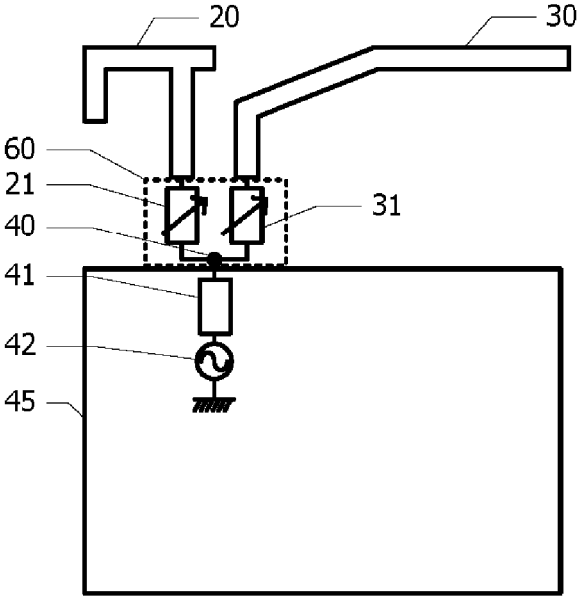

FIGS. 17A to 17C illustrate a schematic diagram of an antenna device according to Embodiment 10. In the example configuration illustrated in FIG. 17A, the high-frequency variable reactance circuit 21, the low-frequency variable reactance circuit 31, the branching point 40 and the matching circuit 41 are realized using a single matching circuit module 60. In the example configuration illustrated in FIG. 17B, the high-frequency variable reactance circuit 21 and the low-frequency variable reactance circuit 31 are realized using a single matching circuit module 60. In the example configuration illustrated in FIG. 17C, the high-frequency variable reactance circuit 21, the low-frequency variable reactance circuit 31 and the branching point 40 are realized using a single matching circuit module 60.

Figure 18A:
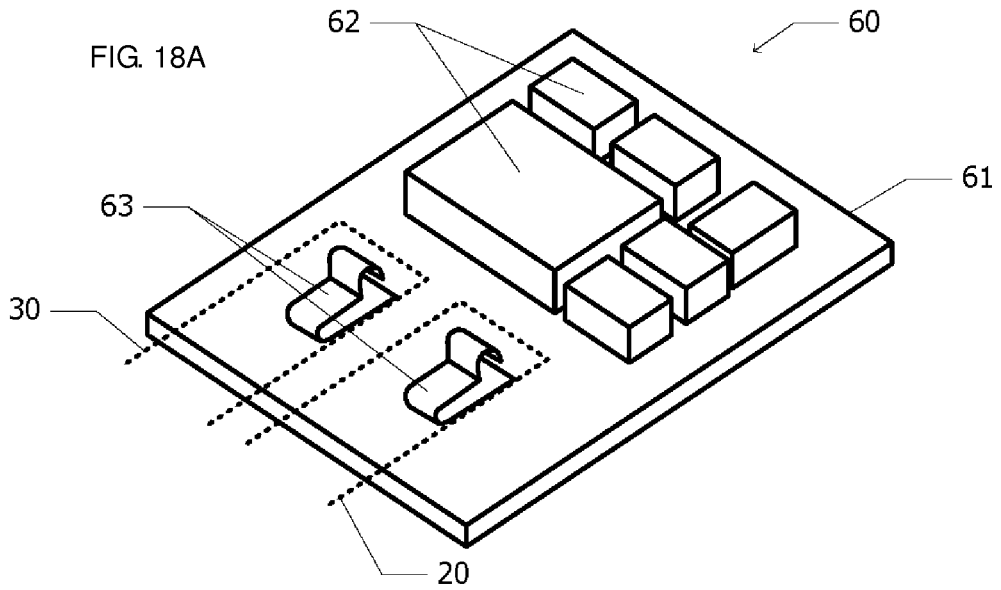
FIGS. 18A and 18B are perspective views of a matching circuit module used in the antenna device according to Embodiment 10.

A perspective view of the matching circuit module 60 is illustrated in FIG. 18A. A plurality of high-frequency electronic components 62 are mounted on a mounting substrate 61. The high-frequency electronic components 62 include reactance elements constituting the high-frequency variable reactance circuit 21, the low-frequency variable reactance circuit 31 and the matching circuit 41 of the antenna device according to any one of Embodiments 1 to 9, and the single pole single throw switches 53 (FIG. 16A) and the single pole multiple throw switch 54 (FIG. 16B).

Two contact terminals 63 are mounted on the mounting substrate 61. The two contact terminals 63 are respectively in contact with the high-frequency radiating element 20 and the low-frequency radiating element 30. The contact terminals 63 are for example formed of flat springs. Electrical contact between the contact terminal 63 and the high-frequency radiating element 20 and electrical contact between the contact terminal 63 and the low-frequency radiating element 30 is maintained through the elastic force of the flat springs.

Figure 18B:
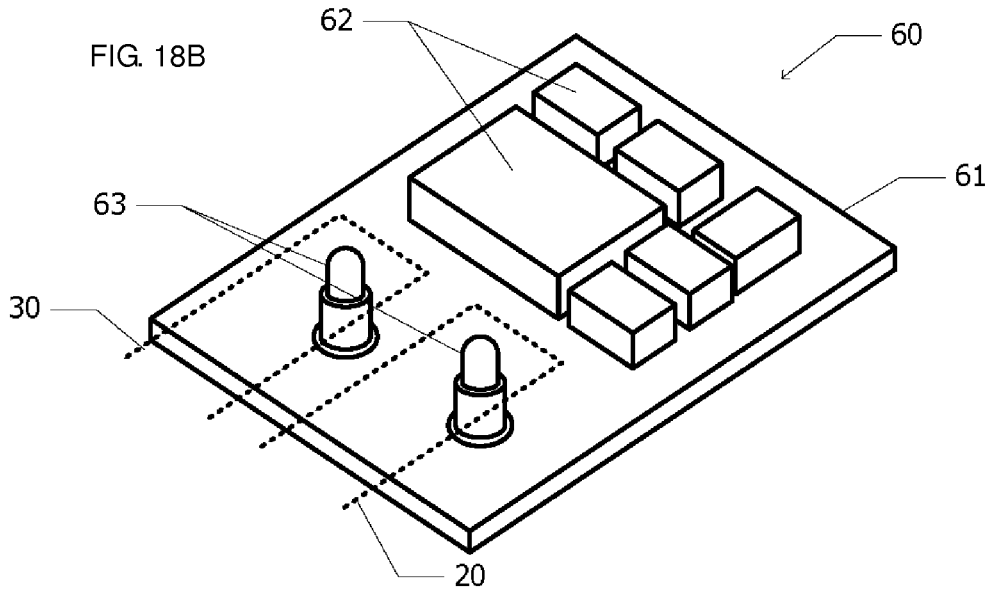

Another example configuration of the matching circuit module 60 is illustrated in FIG. 18B. In the example configuration illustrated in FIG. 18B, the contact terminals 63 each include a movable pin that can be raised and lowered with respect to the mounting substrate 61. When the high-frequency radiating element 20 or the low-frequency radiating element 30 is brought into contact with the tip of the movable pin and the movable pin is depressed, electrical contact between the high-frequency radiating element 20 or the low-frequency radiating element 30 and the movable pin is maintained by the restoring force of an elastic member such as a coil spring.

In Embodiment 10, the matching circuit module 60 can be easily mounted in a variety of antenna devices. In addition, since the matching circuit module 60 is provided with the contact terminals 63 for allowing connection of the high-frequency radiating element 20 and the low-frequency radiating element 30, the high-frequency radiating element 20 and the low-frequency radiating element 30 can be easily attached to and detached from the matching circuit module 60.

While preferred embodiments of the disclosure have been described above, it is to be understood that variations and modifications will be apparent to those skilled in the art without departing from the scope and spirit of the disclosure.

The scope of the disclosure, therefore, is to be determined solely by the following claims.

What is claimed is:

1. An antenna device comprising:

a low-frequency radiating element and a high-frequency radiating element configured so as to respectively operate in a relatively low frequency band and a relatively high frequency band that are non-contiguous with each other;

a transmission/reception circuit;

a matching circuit inserted between the transmission/reception circuit and a branching point;

a high-frequency variable reactance circuit inserted between the branching point and the high-frequency radiating element; and a low-frequency variable reactance circuit inserted between the branching point and the low-frequency radiating element;

the high-frequency variable reactance circuit and the low-frequency variable reactance circuit being configured such that their reactances are adjusted independently of each other.

2. The antenna device according to claim 1, wherein the transmission/reception circuit has a carrier aggregation function of aggregating a carrier of the relatively low frequency band and a carrier of the relatively high frequency band, and wherein in a case where power is supplied from the transmission/reception circuit to the relatively high-frequency radiating element and the low-frequency radiating element, the reactances of the high-frequency variable reactance circuit and the low-frequency variable reactance circuit are set such that return loss from the high-frequency radiating element has a minimum value in the relatively high-frequency band and return loss from the low-frequency radiating element has a minimum value in the low-frequency band.

3. The antenna device according to claim 2, wherein the matching circuit includes a resonant circuit that causes plural resonances to be generated in the low frequency band or the high frequency band.

4. The antenna device according to claim 2, wherein the transmission/reception circuit has a function of transmitting and receiving a signal in a third frequency band different from the relatively high-frequency band and the low-frequency band, and wherein in a case where power is supplied from the transmission/reception circuit to the high-frequency radiating element and the low-frequency radiating element, the reactances of the high-frequency variable reactance circuit and the low-frequency variable reactance circuit are set such that the return loss from at least one of the low-frequency radiating element and the high-frequency radiating element has a minimum value in the third frequency band.

5. The antenna device according to claim 1, wherein at least one of the high-frequency variable reactance circuit and the low-frequency variable reactance circuit includes a switch that switches between at least two states selected from a state in which an inductance is inserted, a state in which a capacitance is inserted, a state in which a combination circuit composed of an inductance and a capacitance is inserted, and a through state.

6. The antenna device according to claim 1, further comprising:

a base ground conductor, wherein the high-frequency variable reactance circuit and the low-frequency variable reactance circuit are arranged at positions spaced away from the base ground conductor.

7. The antenna device according to claim 1, wherein the high-frequency variable reactance circuit, the low-frequency variable reactance circuit and the matching circuit form a matching circuit module.

8. The antenna device according to claim 7, wherein the matching circuit module includes two contact terminals that are respectively in contact with the high-frequency radiating element and the low-frequency radiating element.

9. The antenna device according to claim 8, wherein the two contact terminals maintain a state of being in contact with the high-frequency radiating element and the low-frequency radiating element through their respective elastic forces.

10. A matching circuit module for an antenna device, the matching circuit module comprising:

a matching circuit connected to a transmission/reception circuit;

two contact terminals connected to different radiating elements;

a low-frequency variable reactance circuit inserted between the matching circuit and one of the contact terminals; and a high-frequency variable reactance circuit inserted between the matching circuit and the other one of the contact terminals, a reactance of the low-frequency variable reactance circuit and a reactance of the high-frequency variable reactance circuit are changed independently of each other.

11. The matching circuit module for an antenna device according to claim 10, wherein at least one of the high-frequency variable reactance circuit and the low-frequency variable reactance circuit includes a switch that switches between at least two states selected from a state in which an inductance is inserted, a state in which a capacitance is inserted, a state in which a combination circuit composed of an inductance and a capacitance is inserted, and a through state.

12. The matching circuit module for an antenna device according to claim 10, wherein the two contact terminals maintain a state in contact with the radiating elements through their respective elastic forces.

* * * * *